US008789585B2

(12) United States Patent
Leising et al.

(10) Patent No.: US 8,789,585 B2
(45) Date of Patent: Jul. 29, 2014

(54) CABLE MONITORING IN COILED TUBING

(75) Inventors: Larry J. Leising, Missouri City, TX (US); Frank Espinosa, Sugar Land, TX (US); Michael H. Kenison, Richmond, TX (US); Zefer Erkol, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 428 days.

(21) Appl. No.: 13/231,114

(22) Filed: Sep. 13, 2011

(65) Prior Publication Data

US 2012/0085531 A1 Apr. 12, 2012

Related U.S. Application Data

(60) Provisional application No. 61/390,926, filed on Oct. 7, 2010.

(51) Int. Cl.
*G02B 6/00* (2006.01)
*E21B 47/00* (2012.01)

(52) U.S. Cl.
CPC ..... *E21B 47/00* (2013.01)
USPC ..... 166/250.01; 166/77.2; 385/12

(58) Field of Classification Search
USPC ..... 166/77.2, 250.01, 381, 385; 73/826; 385/12, 13
See application file for complete search history.

(56) References Cited

U.S. PATENT DOCUMENTS

| | | | | |
|---|---|---|---|---|
| 5,182,779 | A * | 1/1993 | D'Agostino et al. | 385/13 |
| 6,999,641 | B2 * | 2/2006 | Williams et al. | 385/12 |
| 7,277,162 | B2 * | 10/2007 | Williams | 356/32 |
| 7,444,861 | B2 * | 11/2008 | De Jesus et al. | 73/152.59 |
| 2005/0045343 | A1 * | 3/2005 | Bixenman et al. | 166/385 |
| 2005/0263281 | A1 * | 12/2005 | Lovell et al. | 166/255.1 |
| 2006/0096753 | A1 * | 5/2006 | Zheng et al. | 166/250.01 |
| 2007/0251687 | A1 * | 11/2007 | Martinez et al. | 166/250.1 |
| 2010/0319910 | A1 * | 12/2010 | Ives et al. | 166/250.01 |

* cited by examiner

*Primary Examiner* — Shane Bomar
*Assistant Examiner* — Steven MacDonald
(74) *Attorney, Agent, or Firm* — Chadwick A. Sullivan; Brigitte Echols

(57) ABSTRACT

The present disclosure relates to a coiled tubing unit. The coiled tubing unit may include coiled tubing with a cable disposed within the coiled tubing. Further, the coiled tubing unit may include a spool about which at least a portion of the coiled tubing is wound, an injector header configured to move the coiled tubing, and a cable slack monitoring feature. The cable slack monitoring feature may be configured to detect an accumulation of cable slack in a portion of the coiled tubing.

13 Claims, 4 Drawing Sheets

CABLE MONITORING IN COILED TUBING

CROSS REFERENCE TO RELATED APPLICATION

This application claims the benefit of U.S. Provisional Application No. 61/390,926 filed Oct. 7, 2010, the entirety of which in incorporated by reference.

FIELD OF THE INVENTION

The disclosure relates to coiled tubing drilling. More specifically the disclosure relates to cable monitoring in coiled tubing.

BACKGROUND OF THE DISCLOSURE

Coiled tubing is utilized in numerous field operations related to drilling and maintaining wells. For example, coiled tubing units are often employed in oil and gas wells to perform well unloading, acidizing/stimulation, tool conveyance, well logging, drilling, fracturing, and so forth. Coiled tubing refers to a continuous length of pipe or tubular product that can be wound on a spool. Coiled tubing is typically 1 inch to 4.5 inches in diameter and is used by a coiled tubing unit in field operations for production, maintenance, and intervention. Depending on the tubing diameter and the associated spool size, coiled tubing can range from 2,000 feet to 20,000 feet or greater in length.

Coiled tubing is often used in field operations to perform functions similar to those performed by some wireline systems. Indeed, coiled tubing may be utilized in conjunction with wireline that is disposed within the coiled tubing to facilitate communication with a downhole tool coupled to the coiled tubing, enable the supply of power to downhole monitoring devices, or the like. In contrast to operations that merely utilize wireline, coiled tubing operations involve pushing the coiled tubing into a wellbore rather than relying on gravity to facilitate lowering the wireline into the wellbore. During a typical coiled tubing operation, the coiled tubing is substantially straightened and pushed into a wellbore with an injector header. Further, the injector header is used to retract the coiled tubing from the wellbore by rewinding it onto a storage spool. In certain coiled tubing operations, coiled tubing is extended into a wellbore and rewound multiple times in order to perform maintenance, remove drill cuttings, and so forth.

Many coiled tubing applications include the use of a downhole tool (e.g., any of various tool strings or downhole instruments) connected to the coiled tubing at the downhole end. In some coiled tubing applications, wireline cable is pumped into the coiled tubing, connected to surface equipment, and connected to the downhole tool at the downhole end of the coiled tubing. The physical connection of the downhole tool to the coiled tubing is achieved via a coil connector, which is a downhole device designed for such connections and designed to withstand related functional and environmental stresses. The process of connecting the downhole tool with the coiled tubing and/or the wireline is typically referred to as "heading up" the coiled tubing assembly, which is difficult and time consuming.

For various reasons (e.g., equipment fatigue or accumulation of wireline slack) during a coiled tubing operation, it often becomes necessary or desirable to rehead the coiled tubing. In other words, it becomes necessary to disconnect the downhole tool from the downhole end of the coiled tubing and/or wireline and then head up the coiled tubing again (i.e., reconnect the downhole tool to the coiled tubing and/or the wireline). This requires the inconvenient tasks of pulling the coiled tubing from the wellbore, removing the downhole tool, and reattaching the downhole tool to the coiled tubing assembly. Also, this generally includes cutting the coiled tubing, performing certain maintenance issues (e.g., repositioning the wireline), and so forth. It is now recognized that reheading the coiled tubing may be performed more frequently than necessary because the level of equipment fatigue, accumulated wireline slack, or the like is unknown.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
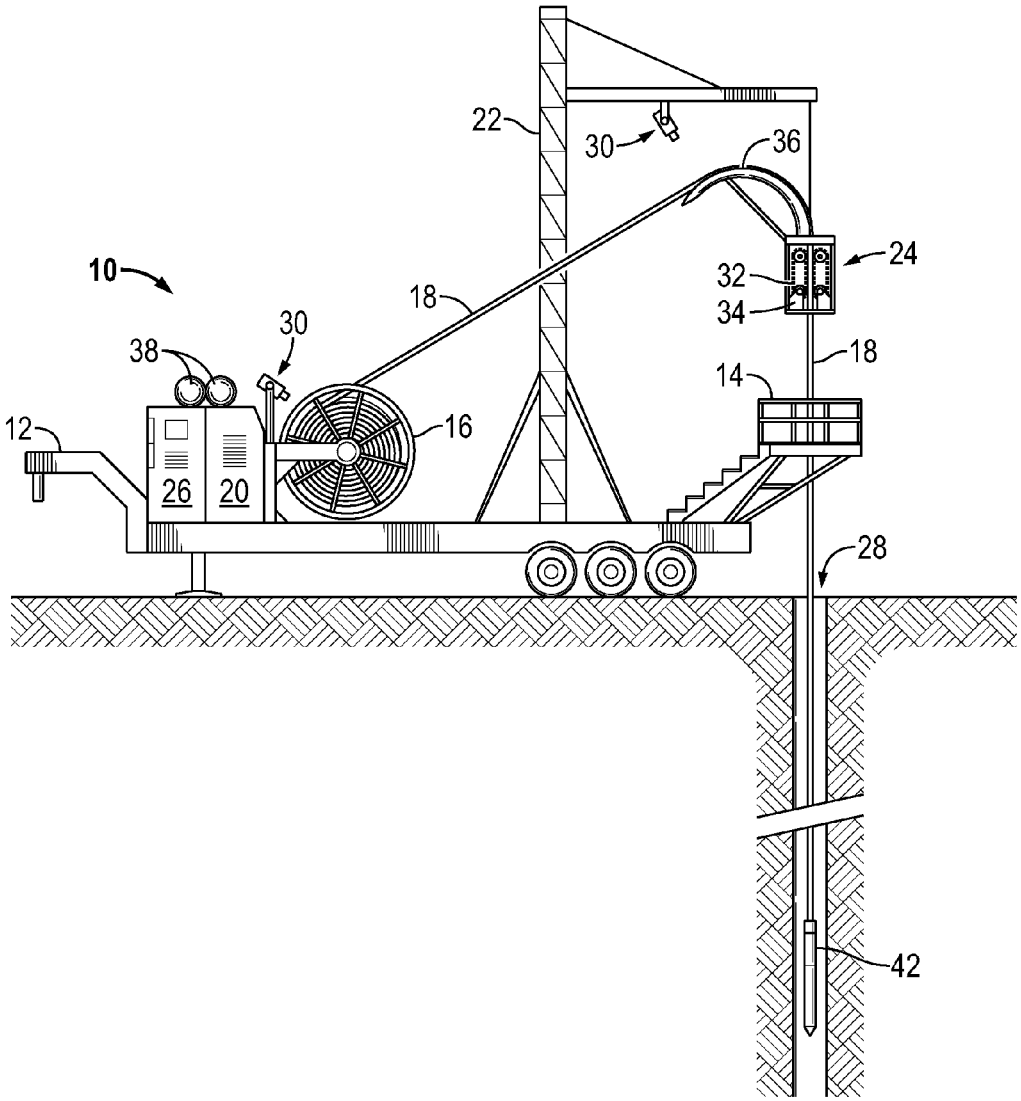
FIG. 1 is a side elevation view of a coiled tubing unit or rig in accordance with one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is generally directed to cable slack and stretch management and monitoring during well operations. For example, the present disclosure includes embodiments directed to addressing issues related to tension and slack management of cable inside of coiled tubing, slickline, and the like. Cable may include electrical communication or transmission lines (e.g., e-line), physical support cables, wireline and so forth. In some coiled tubing operations, cable is disposed within the coiled tubing for various purposes. For example, the cable may connect to a downhole tool that is coupled to the coiled tubing to provide power to the downhole tool, facilitate monitoring of the downhole tool, transfer data to and/or from the downhole tool, and/or enable control of the downhole tool from the surface. In other situations, the cable may be disposed within the coiled tubing for different purposes. Regardless of the intended purpose for including the cable in the coiled tubing, the cable disposed within the coiled tubing is typically longer than the coiled tubing to provide a certain amount of leeway during operation. In other words, a certain amount of cable slack is included in the cable disposed in the coiled tubing to avoid issues with binding and tension on the cable. When a coiled tubing operation is initiated, the cable may be pumped into the coiled tubing such that the slack in the cable is essentially distributed throughout the coiled tubing or such that the cable slack predominantly resides in the portion of the coiled tubing that will at least initially remain uphole during operation.

It is now recognized that while the cable initially includes extra length at the uphole end of the coiled tubing, the cable eventually migrates downhole during operation such that slack is taken from the cable located uphole and is transferred to the cable located downhole. Once a certain amount of cable slack is present in the downhole portion of the coiled tubing, issues frequently arise that interfere with operational efficiency. For example, tension on the uphole portion of cable naturally arises due to an accumulation of cable slack downhole. This uphole cable tension, which results from the accumulation of downhole slack in the cable, can cause cable breakage or stretching, compression and buckling of the coiled tubing and/or damage to related equipment, and so forth. Further, it is now recognized that issues related to an accumulation of downhole slack in the cable can require additional reheading trips, which waste time and materials. It is also noted that excessive cable slack in uphole portions of the coiled tubing can cause issues that interfere with coiled tubing operations. Accordingly, present embodiments are directed to monitoring and/or managing cable slack.

FIG. 1 is a side elevation view of a coiled tubing unit or rig 10 in accordance with present embodiments. The rig 10 includes features and equipment that cooperate to perform continuous-length or coiled tubing operations, such as well maintenance, well intervention, and drilling. In the illustrated embodiment, the rig 10 includes a base 12 and a work platform 14, which provide a stable foundation for operation of the rig 10 and facilitate access to equipment for maintenance and operation of the rig 10.

The rig 10 also includes a spool 16, coiled tubing 18, and cable (not shown) disposed within the coiled tubing 18. The spool 16 provides for storage and transportation of the coiled tubing 18, which is wound about the spool 16. Further, the rig 10 includes a power unit 20, a mast 22, an injector head 24, and a control system 26. The power unit 20 generates the power (e.g., hydraulic and pneumatic power) utilized in operation of the rig 10. For example, the power unit 20 may supply hydraulic or electric power to the injector head 24, which provides drive forces to run and retrieve the coiled tubing 18 from a wellbore 28 or the like. The mast 22 supports the injector head 24 over the work platform 14 to facilitate access to the associated wellbore 28, and the control system 26 facilitates equipment monitoring and control. For example, the control system 26 may include a computer with a processor and a non-transitory computer readable medium (e.g., a memory) storing code or instructions for performing certain operations. The control system 26 may include inputs, outputs, sensors, actuators, and so forth. The inputs of the control system 26 may receive information from sensors (e.g., a light transmission sensor, a load sensor, or a camera) positioned throughout the rig 10 and provide instructions to actuators or the like via outputs of the control system 26, thus implementing actions dictated by the code based on data from the sensors. Sensors, actuators, inputs, outputs, and associated code stored in memory may be referred to as features of the control system 26. The processor, memory, and stored code, which may be referred to as a data analysis element or monitoring feature of the control system 26, may perform analysis of data received from the sensors and so forth, which may be referred to as data acquisition elements. As an example, the control system 26 may include features for instructing the injector head 24 to inject or retrieve the coiled tubing 18 from the wellbore 28 based on cable tension or slack detected by data analysis elements after analyzing information provided to the control system 26 by the data acquisition elements.

The control system 26 may communicatively couple with the cable disposed in the coiled tubing 18, and/or one or more separate monitoring features 30 (e.g., sensors or cameras), such that data from the cable and/or the monitoring features 30 related to cable slack or tension can be retrieved and the presence of tension or accumulated cable slack can be addressed. The data may include, among other things, an optical transmission value through the cable associated with slack, sensor output associated with tension, or the like. The control system 26 may analyze acquired data with a programmed processor and/or compare the data to empirical data (e.g., data acquired by testing) stored in a memory of the control system 26 to identify whether tension in the cable or cable slack accumulation has occurred or likely occurred. For example, in one embodiment, the control system 26 may receive data that relates to a certain level of accumulation of downhole slack in the cable from a monitoring feature, such as a fiber optic component of the cable. As another example, the control system 26 may receive data from one or more monitoring features 30 that is indicative of a change in tubing geometry or cable geometry, which may correspond to tension in the uphole portion of the cable resulting from the presence of downhole cable slack. Specifically, for example, the monitoring feature 30 may include a camera that identifies geometric changes in the coiled tubing 18 and/or components of the injector head 24 that correspond to cable tension or slack. In another embodiment, the monitoring feature 30 may include a monitor configured to detect cable stretch and/or tension on the cable at the spool 16, which can be utilized by the control system 26 to determine positioning of the cable in the coiled tubing 18. The control system 26 may compare the data acquired from the monitoring features 30 with empirical data (e.g., a table of testing data) to identify cable conditions. In one embodiment, the control system 26 may include an optical device that couples with a fiber optic cable and measures distributed strain along the entire length of the fiber optic cable to facilitate identification of localized tension.

As indicated above, the base 12 provides a foundation for various operational components of the rig 10, such as the spool 16, the power unit 20, the mast 22, and the injector head 24. Each of these features is illustrated in a particular arrangement and with specific characteristics in FIG. 1. In other embodiments, these features may be arranged differently, may include different characteristics, may provide additional functionality, or the like. For example, in the illustrated embodiment, the base 12 includes a wheeled trailer, which facilitates transportation of equipment associated with the rig 10 and establishes a stable foundation for operation of such equipment. In other embodiments, the base 12 may include any number of different transportation and/or stabilization features. For example, the base 12 may include a motorized vehicle that is attached to or integral with the trailer. Similarly, the base 12 may include a boat, a barge, a platform, or a skid. It should also be noted that, while FIG. 1 depicts a specific type of the mast 22, in other embodiments, the mast 22 may include a crane, a gin pole, or the like to facilitate lifting the injector head 24 and/or holding the injector head 24 in a desired location.

The spool 16 coordinates with the injector head 24 to supply the coiled tubing 18, and the injector head 24 controls and directs movement and positioning of the coiled tubing 18. The spool 16 may be a reel that is capable of storing and facilitating transport of the coiled tubing 18 for use at a wellsite. In some embodiments, the spool 16 may incorporate a manifold and swivel to facilitate pumping fluids through the coiled tubing 18, a levelwind assembly to facilitate properly spooling of the coiled tubing 18 onto a drum of the spool 16, and a treatment system for providing protective coatings on the coiled tubing 18. The injector head 24 may incorporate profiled chain assemblies 32 that are capable of gripping the coiled tubing 18 and a drive system 34 that provides the tractive effort for expelling and retrieving the coiled tubing 18. A gooseneck 36 mounted on a top of the injector head 24 guides the coiled tubing 18 around an arc of the gooseneck 36 and into the injector head to facilitate straightening of the coiled tubing 18 and vertical alignment with features of the injector head 24, such as the chain assemblies 32. The functions of the spool 16 and the injector head 24 may be powered via the power unit 20. For example, the power unit 20 may hydraulically power these features using hydraulic fluid from storage vessels 38.

The spool 12 may include a length (e.g., 2,000 ft to 20,000 ft) of the coiled tubing 14 wound about a drum of the spool 12. During operation of the rig 10, the coiled tubing 18 extends from the spool 12 to the injector head 24, which engages and directs the coiled tubing 18 into and out of the wellbore 28 through the work platform 14. Specifically, as indicated above, the coiled tubing 18 passes into the gooseneck 36 of the injector head 24, which may facilitate straightening of the coiled tubing 18 and generally aligns the coiled tubing 18 with other components of the injector head 24. Since the gooseneck 36 is essentially a transition point for the coiled tubing 18, it is also a point of tension in the cable disposed within the coiled tubing 18 when a portion of the cable it taut, such as when cable slack accumulates downhole. Accordingly, the gooseneck 36 is frequently the location of damage caused by tension in the cable. For example, the coiled tubing 18 positioned near the gooseneck 36 may be deformed due to compression caused by tension in the cable, or the gooseneck itself may be damaged. Further other portions of the rig 10 may be damaged as a result of tension caused by migration of slack in the cable. Accordingly, present embodiments are directed to detecting and controlling cable slack and tension by monitoring slack, tension, and associated results (e.g., rig deformation) and performing corrective measures, such as reheading the coiled tubing when certain levels of tension or slack in the cable are identified.

It should be noted that the coiled tubing 18 may be coupled with a downhole tool 42 in accordance with present embodiments and that damage may also occur to the downhole tool 42 when cable slack or tension becomes excessive in a particular location. For example, tension or accumulated slack may put pressure on a point of connection with the downhole tool 42 causing breakage at the point of connection. The downhole tool 42 may include a bottom hole assembly for drilling, a logging tool, a fracturing tool, a well maintenance tool, or the like. In addition to the coiled tubing 18, the cable may also be coupled with the downhole tool 42 to facilitate communication between the control system 26 and the downhole tool 42, provide power to the downhole tool 42, and so forth. When cable slack builds up in the downhole portion of the coiled tubing 18 or excessive tension is placed on the connection between the cable and the downhole tool 42 due to excessive slack in the uphole portion of the coiled tubing 18, operation of the downhole tool 42 may be affected. It is now recognized that it may be desirable to remove the downhole tool 42 and rehead the coiled tubing 18 prior to causing any substantial damage due to excessive accumulation of cable slack 42. Accordingly, present embodiments are directed to identifying accumulated cable slack or cable tension, withdrawing the downhole tool 42 from the wellbore 28, removing the downhole tool 42 from the coiled tubing 18 to access the cable, adjusting the slack in the cable (e.g., pumping the cable into the coiled tubing 18), and reattaching the downhole tool 42.

Figure 2:
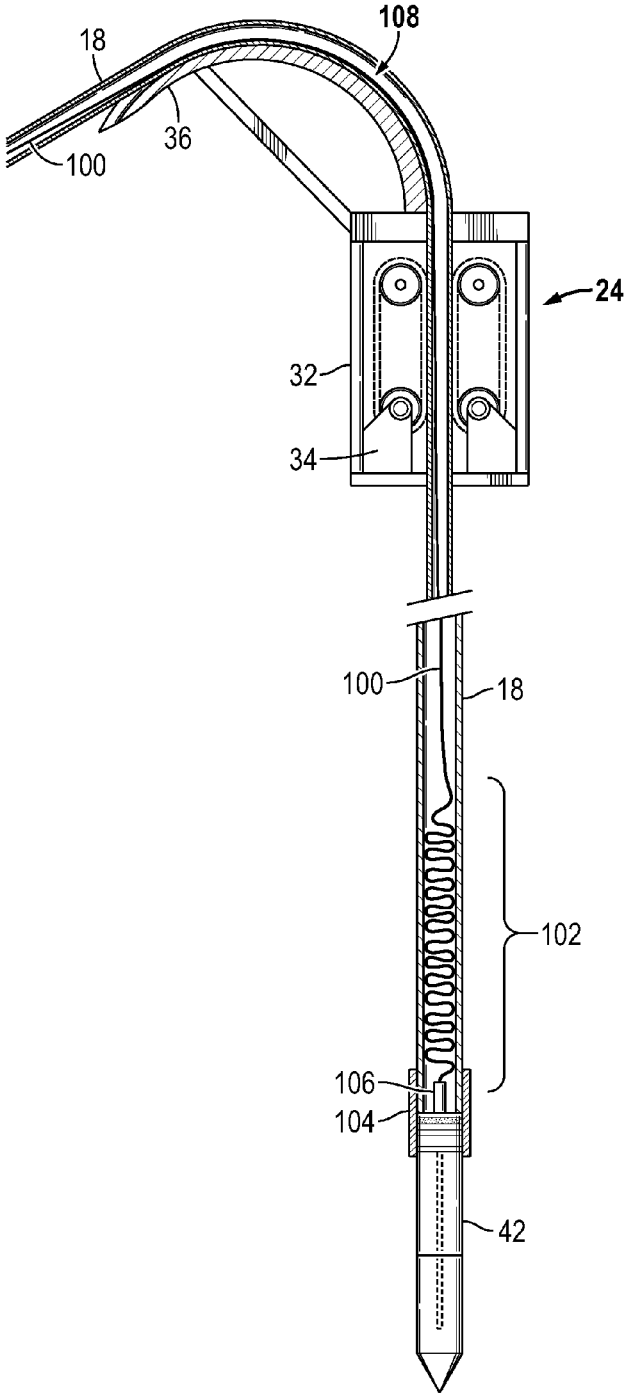
FIG. 2 is a schematic view of an injector header, a downhole tool, and coiled tubing in accordance with one or more aspects of the present disclosure.

FIG. 2 illustrates a schematic view of the injector header 24, the downhole tool 42, and the coiled tubing 18 in accordance with present embodiments. Specifically, FIG. 2 illustrates cable 100 that is disposed within the coiled tubing 18 and that has accumulated slack, as indicated by reference numeral 102, in a downhole portion of the coiled tubing 18 near the downhole tool 42. The downhole tool 42 is coupled to the coiled tubing 18 via a coiled tubing connector 104, which may provide a compressive connection that is adequate to withstand the tensile and compressive forces associated with coiled tubing operations, while ensuring hydraulic isolation between the downhole tool 42 and the coiled tubing 18. Further, the cable 100 is connected to the downhole tool 42 via a cable connector 106, which extends from the downhole tool 42 and attaches with the cable 100 to provide a physical coupling and/or a communicative coupling between the cable 100 and the downhole tool 42. In one embodiment, the cable connector 104, which may be powered by and communicatively coupled to the downhole tool 42, may transmit data from the downhole tool 42 to the control system 26 via the cable 100 and so forth.

As illustrated by FIG. 2, when cable slack accumulates to a certain degree in downhole or uphole portions of the coiled tubing 18, tension is created in the cable 100. Indeed, as indicated by reference numeral 108, the cable 100 has been pulled taut about the bend in the coiled tubing 18 proximate the gooseneck 36. As discussed above, this tension can cause operational difficulties. For example, among other things, the tension in the cable 100 may cause compression in the coiled tubing 18 proximate the gooseneck 36, which may cause buckling and bending of the coiled tubing 18. Additionally, the accumulated slack in the cable 100 indicated by reference numeral 102 may cause problems with the downhole tool 42. For example, the contortion of the cable 100 may damage the cable connector 106.

Embodiments of the present disclosure may avoid and/or address cable slack accumulation and cable tension, such as that indicated by reference numerals 102 and 108 in FIG. 2, by monitoring conditions that may be associated with cable slack and identifying potential situations of concern through comparison of the conditions with empirical data by the control system 26. For example, a transmission value found to be associated with slack accumulation during testing may be compared to a transmission value through an active cable to determine whether slack accumulation is present in the active cable. In one embodiment, this may be achieved by coupling fiber optic cable to the cable, bundling the fiber optic cable with the cable, or otherwise employing fiber optic cable in the cable 100 to obtain data, and analyzing the data with the control system 26 or another monitoring system. Indeed, the cable 100 may be composed of various different cables with various different functions. For example, as illustrated by the cross-sectional view of the cable 100 in FIG. 3, the cable 100 may include e-lines 202 (e.g., electrical communication or transmission lines), physical support cables 204, and so forth. Further, in accordance with the present embodiments, the cable 100 may include one or more fiber optic cables 206.

Each of the component cables of the cable 100 may include specialized features. For example, the e-lines 202 may each include a copper core 212 with a protective coating 214 of non-conductive material (e.g., plastic) disposed about the copper core 212. Indeed, all of the components of the cable may be included within a protective sleeve 216. In other embodiments, the fiber optic cable 206 may be separate but extending adjacent to the cable 100. The fiber optic cable 206 may include a core 222, which carries light pulses, and coating or cladding 224, which reflects the light back into the core 222. The cladding may also include a buffer coating that protects the fiber optic cable 206 from damage, moisture, and so forth.

By including the fiber optic cable 206 as a component of the cable, a quantity of the fiber optic cable 206 disposed in the wellbore 28 can be monitored, and/or a condition (e.g., transmission losses due to bending or vibrations) of the fiber optic cable 206 can be monitored to determine whether slack has accumulated in the cable 100. Indeed, because the fiber optic cable 206 is integral with or attached to the cable 100, the condition of the fiber optic cable 206 and the amount of fiber optic cable 206 disposed in the wellbore 28 will directly correlate to the same aspects of the overall cable 100 based on correlated positioning.

In one embodiment, the length of fiber optic cable 206 disposed within the wellbore 28 may be determined with a distributed temperature survey (DTS). Indeed, a fiber optic DTS can provide a substantially real-time indication of a total amount of fiber optic cable 206 in the wellbore 28, because the transition from ambient temperature on surface to well temperature at the entrance to the wellbore 28 provides a temperature signature that can be used to differentiate fiber length above the wellbore 28 entrance and fiber length inside the wellbore 28. Slack in the cable 100 can be identified by comparing the length of the fiber optic cable 206 in the wellbore 28 with a total length of the coiled tubing 18 in the wellbore 28. The length of the coiled tubing 18 disposed in the wellbore may be determined by a device, such as a universal tubing-length monitor (UTMB), that measures the length of the coiled tubing 18 as it comes off of the spool 16 when it is being run into the wellbore 28 by the injector head 24. Slack in the cable may be identified by providing an output for every stage of the injection of the coiled tubing 18 in substantially real time. The output may include a relative measure of the length of fiber optic cable 206 and the length of the coiled tubing 18. For example, if a ratio of fiber optic cable length to coiled tubing length exceeds a certain level, excessive slack may be determined to be present. In one embodiment, the footage of fiber optic cable 206 per foot of coiled tubing 18 may be presented as a measure of slack. Indeed, such a measure may be presented as a percentage of slack per length of coiled tubing 18. This slack measurement may be utilized in an analysis or modeling computer and/or compared to empirical data. If the model output or comparison with empirical data indicates that a certain slack measurement corresponds to a precursor for potential damage or inefficiency related to the presence of accumulated cable slack, the slack can be addressed. For example, slack may be added in the cable 100 and/or the coil tubing 18 may be pulled from the wellbore 28 for reheading and repositioning of the cable 100 within the coiled tubing 18.

Figure 3:
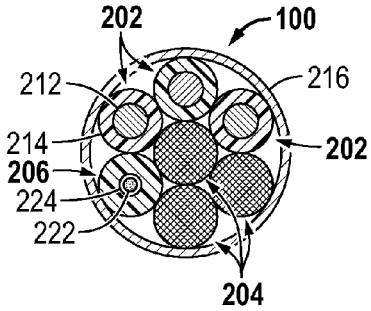
FIG. 3 is a cross-sectional view of a cable incorporating a fiber optic cable in accordance with one or more aspects of the present disclosure.

In another embodiment, characteristics associated with transmission of light through the fiber optic cable 206 may be utilized to identify slack in the cable 100. For example, an optical device. As illustrated in FIG. 3 and briefly discussed above, the fiber optic cable 206 includes the core 222 for transmitting light pulses and the cladding 224 for reflecting the pulses back into the core 222. The core 222 and the cladding 224 each have a different index of refraction to facilitate propagation of the light pulses through the fiber optic cable 206. Indeed, when light passes from a first medium (e.g., the core 222) having a first index of refraction to a second medium (e.g., the cladding 224) with a second index of refraction that is lower than the first index of refraction, the light bends or refracts away from an imaginary line perpendicular to the surface between the two mediums. When the light is traveling at an angle greater than a critical angle relative to the surface, the light will consistently be reflected back into the core 222 and will, thus, travel through the core 222. Optical fibers typically exhibit propagation losses when they are bent. These losses rise very quickly once a certain critical bend radius of the optical fiber is reached. The critical bend radius is generally dependent on the type of fiber optic cable utilized and the type of light wave utilized. Indeed, different types of features and cladding may be utilized in manufacturing the fiber optic cable 206 to provide it with a particular critical radius. For example, single-mode fibers with large mode areas typically have relatively large critical bend radiuses. Similarly, different light waves may be utilized to increase or decrease susceptibility to bend losses. Generally, longer wavelengths exhibit a high amount of bend losses. Wavelength dependence is often strongly oscillatory.

It is now recognized that such characteristics may be utilized to identify cable slack in accordance with present embodiments. Indeed, when slack accumulates in the cable 100, the slack corresponds to bending in the cable 100. As slack accumulates, more bending occurs. Thus, increases or decreases in bending (and associated slack) may be detected by identifying a loss in propagation of light pulses through the fiber optic cable 206 that is integral with the cable 100. In other words, bending or slack in the cable 100 can be calculated from the detection of losses in light propagation through the fiber optic cable 206. For example, very specific determinations regarding the slack or configuration of the cable 100 may be made by comparison of light propagation losses to empirical data that may indicate a degree of slack. Further, the type of fiber optic cable utilized in the cable 100 may be selected based on a desired or typical bend radius associated with slack to facilitate identification of the slack.

In one embodiment, patterns in light transmissions through the fiber optic cable 206 may be utilized to identify the presence of slack in the cable 100. For example, the cladding 224 may be specifically selected or designed such that when there are multiple bends in the fiber optic cable 206, as will occur when there is slack in the cable 100, the transmitted or reflected light creates a pattern that is different than the norm. Indeed, empirical or modeling data may be utilized to identify when certain patterns in the light are indicative of contortions in the cable 100 due to slack and so forth. While irregularity on coatings or claddings for fiber optic cables is typically considered undesirable, it may be utilized as an advantage in present embodiments for identifying slack and the location of the slack along the cable 100. Similarly, vibration along the fiber optic cable 206 may be monitored and analyzed to infer its position and configuration along the coiled tubing 18.

Figure 4:
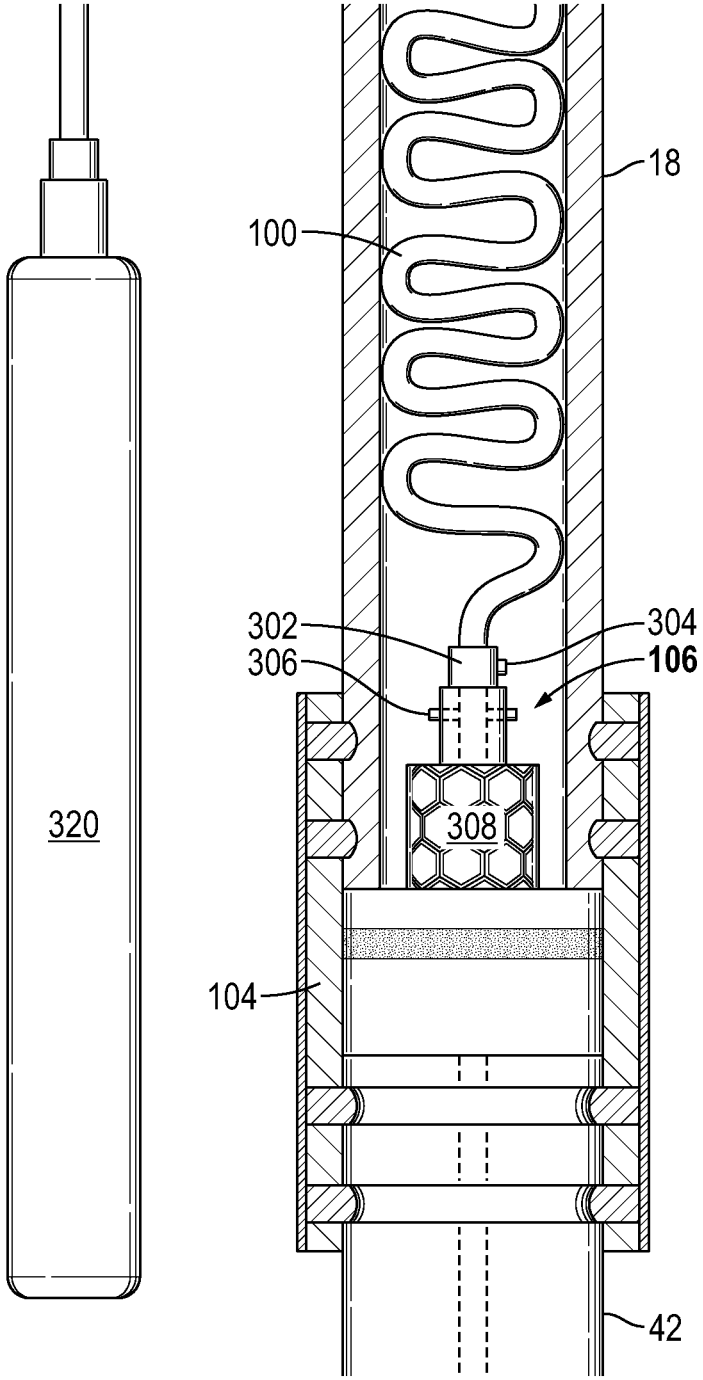
FIG. 4 is a schematic view of a downhole tool coupled with coiled tubing and a cable in accordance with one or more aspects of the present disclosure.

FIG. 4 is an expanded view of portions of FIG. 2 that represent the connection of the coiled tubing 18 and the cable 100 with the downhole tool 44 in accordance with present embodiments. Specifically, FIG. 4 illustrates the coiled tubing connector 104, which couples the coiled tubing 108 to the downhole tool 42, and the cable connector 106, which couples the cable 100 with the downhole tool 42. In accordance with present embodiments, the cable connector 106 and/or related components may be utilized to detect cable slack or tension in accordance with present embodiments. It should be noted that while FIG. 4 provides representations of various different features that may be utilized together in accordance with present embodiments, certain features may be utilized separately or in different configurations.

In one embodiment illustrated by FIG. 4, for example, the cable connector 106 may include a cable clamp 302 with a load sensing device 304 to facilitate identification of excessive pulling or pushing that may be indicative of slack and/or tension in the cable 100. For example, observation of a gradual buildup of tension via the load sensing device 304 may provide a warning that the downhole portion of the coiled tubing 18 is about to be pulled out of its position. As another example, the load sensing device 304 may identify compression between the cable 100 and the downhole tool 42 associated with accumulated slack in the downhole portion of the coiled tubing 18 or tension caused by accumulated slack in the uphole portion of the coiled tubing 18. When tension or compression detected by the load sensing device 304 exceeds certain predefined thresholds, it may transmit a warning signal to the control system 26 via an e-line of the cable 100 or wirelessly.

In other embodiments, different and/or additional features may be utilized to identify compression or tension in the cable. For example, a mechanical tool for detection of deformation caused by slack may include a pin 306 that may break due to strain (e.g., compression or tension). Breaking the pin 306, which may include a circuit, may provide a hydraulic or electrical indication to the control system 26 by releasing hydraulic fluid, transmitting or ceasing to transmit an electrical signal, or the like. Further, the cable connector 106 may include a device for detecting load on the cable connector 106. For example, the cable connector 106 may include a memory gauge or a mechanical device that is indicative of load, such as crush tubes 308 (e.g., honeycomb crush tubes). The crush tubes 308 may be calibrated or configured to consistently deform when certain types of pressure are applied. Indeed, the crush tubes 308 may be configured to deform to a certain extent when pressure from tension or slack in the cable 100 reaches a certain point that is indicative of pending issues. The deformation may be monitored via integral electrical and/or hydraulic components to provide an indication of the associated pressure to the control system 26.

As previously discussed with regard to FIG. 1, monitoring features such as the monitoring features 30 may be utilized to observe certain physical characteristics of the coiled tubing 18 or related features to identify the presence of accumulated cable slack. For example, the monitoring feature 30 in FIG. 1 may include a camera capable of acquiring images of certain geometric characteristics of the coiled tubing 18 or the gooseneck 36 to identify slight deformations in the coiled tubing 18 and/or gooseneck 36 associated with tension in the cable 100. Indeed, acquired geometric information may be compared to empirical data to determine when an unacceptable amount of tension and potential accumulation of slack is present in the cable 100. In other embodiments, various different monitoring features may be utilized to identify the presence of cable tension and/or slack in the coiled tubing 18. For example, as illustrated in FIG. 4, a logging tool 320 capable of performing ultrasonic logging may be employed. The logging tool 320 may be used from the surface or lowered from the surface in a hole adjacent to that in which the coiled tubing 18 is located. The logging tool 320 may be utilized to identify the accumulation of the cable 100 in certain areas of the coiled tubing 18. Indeed, the localization of the cable 100 into a central location due to the accumulation of slack increases the average mass of the section of the coiled tubing 18 in which the slack is gathered. Accordingly, it is now recognized that a log of feedback from the ultrasound emitted by the logging tool 320 would be indicative of gathered slack.

Figure 5:
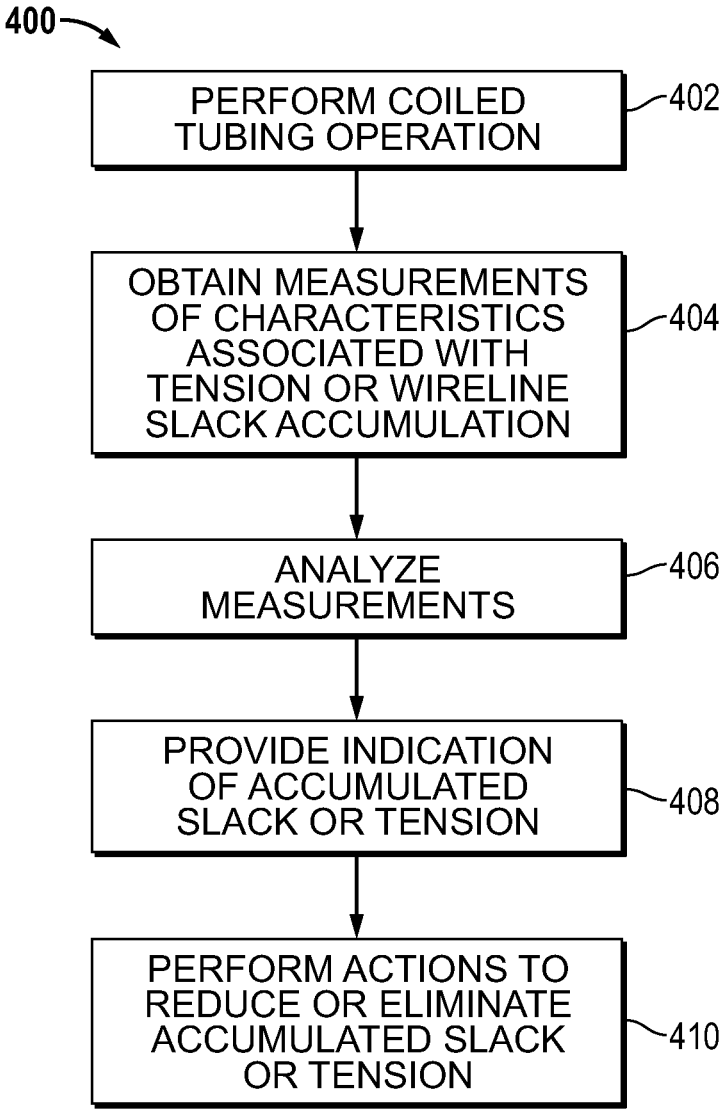
FIG. 5 is a flow-chart diagram of at least a portion of a method in accordance with one or more aspects of the present disclosure.

FIG. 5 is a flow-chart diagram of at least a portion of a method in accordance with the present disclosure. The method is generally indicated by reference numeral 400. The method begins with performing a coiled tubing operation, as represented by block 402. Such an operation may include drilling a well, fracturing a well, maintaining a well, intervening in a well, or the like. Specifically, the operation being performed includes the use of cable disposed in the coiled tubing. During such an operation, a monitoring device may obtain measurements of system characteristics that may be associated with tension and/or an accumulation of cable slack in a portion of the coiled tubing, as represented by block 404. Indeed, in accordance with the present disclosure, block 404 may represent various different types of monitoring. For example, block 404 may represent identifying geometric changes in the coiled tubing, the equipment associated with movement of the coiled tubing (e.g., a gooseneck of an injector head), the cable, and so forth. In another example, block 404 may represent monitoring transmissions of light signals through a fiber optic cable associated with the cable or the results of an ultrasound emission into the coiled tubing. Once data is acquired from the monitoring depicted by block 404, the data may be analyzed by a processor and/or control system, as represented by block 406 to determine whether tension or an accumulation of cable slack is likely to be present in a portion of the coiled tubing. For example, block 406 may represent determining that an accumulation of cable slack is likely present if geometric changes indicate that the coiled tubing is under compression near the injector head, if there is a substantial amount of stretching in the cable, or if there is an indication of a high density in a portion of the coiled tubing, among other things. As another example, block 406 may represent determining that cable slack has likely accumulated because of light patterns or propagation losses in the fiber optic tubing representative of bending associated with cable slack accumulation. These determinations may be performed by a processor that compares empirical data stored on a memory with measured data to identify particular conditions. Once such a determination is made, an indication may be supplied to a user via the control system, as represented by block 408. Further, as represented by block 410, certain actions may be taken based on the identification of accumulated cable slack to address the situation. For example, the coiled tubing may be pulled from a wellbore and reheaded, including a step of pumping the cable back into the coiled tubing to distribute the slack. Block 410 may be initiated automatically upon detection by the control system or by a user that has been alerted to the situation.

The present disclosure includes an embodiment directed to coiled tubing unit. The coiled tubing unit may include coiled tubing, a cable disposed within the coiled tubing, and a spool about which at least a portion of the coiled tubing is wound. Further, the coiled tubing unit may include an injector header configured to move the coiled tubing, and a control system comprising a data analysis element configured to detect tension in the cable or an accumulation of cable slack in a portion of the coiled tubing based on input from at least one data acquisition element configured to sense characteristics associated with tension or slack in the cable.

The present disclosure includes another embodiment directed to a cable slack detection system for a coiled tubing unit. The system may include a cable disposed within coiled tubing, a fiber optic cable bundled with the cable, and a cable slack monitoring feature. The cable slack monitoring feature may be configured to detect an accumulation of cable slack in a portion of the coiled tubing based on changes in light transmission through the fiber optic cable.

The present disclosure includes yet another embodiment directed to a method for identifying and/or controlling cable slack. The method may include emitting light signals from a control system of a coiled tubing unit into a fiber optic cable that bundled with a cable, wherein the cable is disposed within coiled tubing. Further, the method may include detecting transmission characteristics of the light signals through the fiber optic cable with a processor of the control system, and identifying whether an accumulation of cable slack is likely present in a portion of the coiled tubing with the processor based on the transmission characteristics, wherein the transmission characteristics comprise light patterns or propagation losses associated with bending in the fiber optic cable.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A coiled tubing unit, comprising:

coiled tubing;

a cable disposed within the coiled tubing; and a control system comprising a data analysis element configured to detect one of tension in the cable or an accumulation of slack of the cable in a portion of the coiled tubing based on input from at least one data acquisition element configured to sense characteristics associated with one of tension or slack in the cable, wherein the at least one data acquisition element comprises a camera configured to detect relative geometries of at least one of the coiled tubing or an injector head, and the data analysis element is configured to analyze the relative geometries to identify whether one of tension or cable slack has accumulated within the coiled tubing.

2. The coiled tubing unit according to claim 1, wherein the cable comprises a plurality of cables that together are capable of transmitting data and power.

3. The coiled tubing unit according to claim 2, wherein a one of the plurality of cables comprises a fiber optic cable.

4. The coiled tubing unit according to claim 3, wherein the control system comprises an optics system coupled to the fiber optic cable, wherein the optics system is configured to measure distributed strain along a length of the fiber optic cable to facilitate identification of localized tension.

5. The coiled tubing unit according to claim 2, wherein the fiber optic cable is coupled with an optic system configured to transmit light signals into the fiber optic cable, receive light signals from the fiber optic cable, and identify light signal patterns or propagation losses of the light signals corresponding to bends in the fiber optic cable.

6. The coiled tubing unit according to claim 1, wherein the control system is configured to obtain operational data via the at least one data acquisition element that is reflective of one of a presence or absence of cable slack accumulation and configured to compare the operational data to empirical data to identify whether cable slack accumulation is present.

7. The coiled tubing unit according to claim 1, wherein the at least one data acquisition element further comprises a load sensing device coupled between the cable and a downhole tool, which is coupled to an end of the coiled tubing, wherein the load sensing device is configured to provide an indication of compression or tension between the cable and the downhole tool.

8. The coiled tubing unit of claim 1, wherein the data acquisition element comprises a measurement device configured to measure at least one of cable stretch, cable vibration, or force applied to the cable.

9. A coiled tubing unit, comprising:

coiled tubing;

a cable disposed within the coiled tubing; and a control system comprising a data analysis element configured to detect one of tension in the cable or an accumulation of slack of the cable in a portion of the coiled tubing based on input from at least one data acquisition element configured to sense characteristics associated with one of tension or slack in the cable, wherein the data acquisition element comprises a device configured to mechanically deform at a designated level of tension or compression related to cable slack accumulation and to provide an electrical or hydraulic indication upon deformation.

10. The coiled tubing unit according to claim 9, wherein the device comprises an assembly of crush tubes.

11. The coiled tubing unit according to claim 9, wherein the data acquisition element is configured to measure a length of coiled tubing positioned in a wellbore and a measured length of cable positioned in the wellbore, and to provide a tension or slack measurement based on one of a ratio or difference between the measured lengths of coiled tubing and cable.

12. A method, comprising:

emitting light signals from a control system of a coiled tubing unit into a fiber optic cable that is bundled with a cable, wherein the cable is disposed within coiled tubing;

detecting transmission characteristics of the light signals through the fiber optic cable with a processor of the control system;

identifying whether an accumulation of slack of the cable is present in a portion of the coiled tubing with the processor based on the transmission characteristics, wherein the transmission characteristics comprise one of light patterns or propagation losses associated with bending in the fiber optic cable; and detecting geometric changes in one of coiled tubing unit components, cable stretching, and compression or tension related to accumulated cable slack to facilitate identification of detecting geometric changes in one from the group consisting of:

a) coiled tubing unit components;

b) cable stretching; and c) compression or tension related to accumulated cable slack to facilitate identification of cable slack accumulation.

13. The method according to claim 12, wherein identifying whether the accumulation of cable slack is present comprises using the processor to compare the transmission characteristics with empirical data of similar cable characteristics of test cases stored on a memory of the control system.

* * * * *

UNITED STATES PATENT AND TRADEMARK OFFICE

CERTIFICATE OF CORRECTION

PATENT NO. : 8,789,585 B2
APPLICATION NO. : 13/231114
DATED : July 29, 2014
INVENTOR(S) : Larry J. Leising et al.

It is certified that error appears in the above-identified patent and that said Letters Patent is hereby corrected as shown below:

On the title page, item (75), the fourth inventor's name should be corrected as follows.

Correct: Erkol Zafer

Incorrect: Erkol Zefer

Signed and Sealed this
Eleventh Day of November, 2014

Michelle K. Lee

Michelle K. Lee
*Deputy Director of the United States Patent and Trademark Office*